United States Patent [19]

de la Concha-Caceres

[11] Patent Number: 4,743,007

[45] Date of Patent: May 10, 1988

[54] RECREATIONAL DEVICE FOR PRODUCING THE THRILL OF A SERIES OF CONSECUTIVE FREE FALLS

[75] Inventor: Alfonso de la Concha-Caceres, Rafael Alducin, Mexico

[73] Assignee: Free Motion Designs Corporation, Tex.

[21] Appl. No.: 805,432

[22] Filed: Dec. 5, 1985

[51] Int. Cl.[4] ..... A63G 31/00

[52] U.S. Cl. ..... 272/6

[58] Field of Search ..... 272/1 R, 2, 6, 8 R, 272/16, 17, 18; 182/137, 138, 139, 140, 71, 72, 40, 41, 48; 434/247, 258

[56] References Cited

U.S. PATENT DOCUMENTS

| | | | |
|---|---|---|---|
| 309,929 | 12/1884 | Clokey | 182/48 |
| 503,572 | 8/1893 | Beal | 182/140 X |
| 1,088,826 | 3/1914 | Labady | 182/138 |
| 3,348,630 | 10/1967 | Yamamoto | 182/48 |
| 3,484,953 | 12/1969 | Norheim, Jr. | 434/258 |
| 3,580,358 | 5/1971 | Yamamoto | 182/48 |
| 4,037,685 | 7/1977 | Talucci | 182/48 X |
| 4,535,983 | 8/1985 | de-la-Concha-Caceres | 272/6 |

FOREIGN PATENT DOCUMENTS

| | | | |
|---|---|---|---|
| 8302031 | 12/1983 | Brazil | 272/6 |
| 345008 | 12/1921 | Fed. Rep. of Germany | 273/145 B |
| 605281 | 11/1934 | Fed. Rep. of Germany | 182/140 |
| 1038095 | 5/1953 | France | 182/48 |
| 8402658 | 7/1984 | World Int. Prop. O. | 182/48 |
| 2969 | 11/1865 | United Kingdom | 182/139 |
| 1024098 | 6/1983 | U.S.S.R. | 182/48 |

OTHER PUBLICATIONS

Baggett, James A., "Flight Chamber, " *Popular Science Monthly,* New York, N.Y. 10017, vol. 222, No. 3, Mar. 1983, p. 61.

*Primary Examiner*—Richard T. Stouffer
*Attorney, Agent, or Firm*—McGlew and Tuttle

[57] ABSTRACT

A recreational device for producing the thrill of a series of consecutive free falls, which includes a housing, a shock absorbing cushion throughout the bottom of the housing, an inwardly extending peripheral deck near the top of the housing arranged to provide a launching platform for allowing persons to jump into the housing, and a plurality of horizontal planar non-woven nets of elastic bands arranged at different levels within the housing with each net spanning the whole horizontal cross-section of the housing. The elastic bands are randomly arranged within each individual net so as to leave spans between the bands which are insufficiently small to prevent a person from passing through the nets without bouncing on each consecutive net, the elastic bands having an elasticity sufficient to permit persons to manually space the bands to jump from a higher net of bands to a lower net of bands. Each of the horizontal planar non-woven nets are constituted by from 2 to 4 levels of elastic bands, the levels being closely spaced from each other within an individual net to permit the reinforced bouncing of heavy persons whose weight or height of fall may deflect the upper ones of the band levels in an individual net beyond a permissible tolerance.

9 Claims, 2 Drawing Sheets

RECREATIONAL DEVICE FOR PRODUCING THE THRILL OF A SERIES OF CONSECUTIVE FREE FALLS

FIELD OF THE INVENTION

The present invention refers to a recreational device and, more particularly, it is related with a recreational device for enabling persons to jump into a series of consecutive entirely free falls which are arrested by rebounding on a plurality of horizontal non-woven planar elastic nets interposed in the path of the fall of said person at predetermined different but considerably spaced levels.

BACKGROUND OF THE INVENTION

Prior art recreational devices for permitting a person to fall from a predetermined high point down to a predetermined low point, are well known. Said devices, however, generally depend on the use of a slope, be it dry or provided with water for permitting the user to slip down along the same, although there are also a plurality of devices in which the users may jump and slip over a pipe of the type utilized by firemen. Up to the present time, however, with the only exception that will be described hereinbelow, there is no one single recreational device which may permit an absolutely free fall, that is, which may produce the thrill and sensation that the user is jumping into free space, inasmuch as most of the devices of the prior art are provided with means for permitting said falls without losing contact at any moment with a steady structure on which the users slip down. The sensation of a free fall is, as any psychologist may clearly affirm, absolutely different from a supported fall, whereby the thrill caused to the users by a free fall is of a totally distinct nature, and a device which may simulate an entirely free fall, may be very much more thrilling than those in which the falls are made in constant contact with a solid surface, or even than those in which the free fall is constantly arrested by the provision of elastic obstacles in the path of the falling user.

Up to the present time, no recreational device has been created in which the user may feel the sensation of an entirely free fall, although the device described and claimed in U.S. Pat. No. 4,535,983, assigned to the same assignee hereof, may be regarded as constituting a breakthrough towards the provision of this entirely new type of thrill. The recreational device of U.S. Pat. No. 4,535,983, comprises a housing within which a plurality of elastic bands is randomly arranged through a predetermined substantial height of said housing to permit the users to attain the sensation of a free fall which is constantly arrested by the bands, said bands being arranged such that they form an elastic network leaving spans between the bands which are sufficiently small to prevent a person jumping from the deck from passing through the network all the way down without bouncing on one or more of the elastic bands but with the elastic bands having an elasticity sufficient to permit persons to rebound on them as they fall from a higher level of bands to a lower level of bands, and with said bands arranged throughout at least a substantial part of the height of the housing.

The device of U.S. Pat. No. 4,535,983, on the other hand, also shows an embodiment wherein certain part of the bands may be arranged in the form of a horizontal net fixed in a frame which may be moved upwardly or downwardly to enhance the "free fall effect" of the device.

The main embodiment of the device of U.S. Pat. No. 4,535,983, however, does not provide the accurate sensation of a free fall; since the array of the bands which are randomly distributed throughout a substantial height of the housing, does not permit the said free fall, because the same is constantly arrested when the person is falling down through said arrangement of elastic bands.

The second embodiment of the invention of U.S. Pat. No. 4,535,983, on the other hand, only provides movable horizontal beds of elastic bands in addition to randomly distributed individual bands and, although the free fall of the user from said horizontal movable bed of elastic bands onto the randomly distributed elastic bands indeed causes the sensation of an entirely free fall, the remainder of the ride is as described above in connection with the main embodiment of the invention. On the other hand, U.S. Pat. No. 4,535,983 does not suggest any means for compensating the remarkable differences in the impacts caused by differences in the height of fall and/or in the body weight of the prospective users, since said patent only describes a horizontal net of elastic bands in combination with the array of randomly distributed elastic bands, but without providing means to effect said impact differential compensation, which causes that heavy persons falling onto said movable bed of bands from considerable heights from the deck may deflect the individual bands of said bed to an extent which may be regarded as inadmissible.

On the other hand, the device of U.S. Pat. No. 4,535,983, at least throughout the height comprising said randomly distributed individual elastic bands, may cause problems of entanglement of the bands with the human body falling therethrough, because as said human body is encountering individual bands to arrest the free fall, it is not until a sufficient number of bands is gathered that said arresting action may be performed, with the consequence that bands caught by the user at upper levels, will be considerably stretched and possibly entangled with the bands caught at lower levels, with the additional risk of frequent ruptures at the bands laying at said higher levels.

BRIEF SUMMARY OF THE INVENTION

Having in mind the defects of the prior art recreational devices, it is an object of the present invention to provide a recreational device for producing the thrill of a sequence of entirely free falls, which is of a very simple construction and yet of a remarkable performance for producing the effect sought.

It is another object of the present invention to provide a recreational device of the above mentioned character, which will produce a highly thrilling sensation on the users and which will, however, provide a safe operation, avoiding undue shocks to the users even if the body of the users be accidentally placed in an inconvenient position during the falls.

One other object of the present invention is to provide a recreational device of the above mentioned character, which will provide entirely free falls from a plurality of levels in sequence by interposing a corresponding plurality of nets of elastic bands in the path of fall of the user.

One more particular object of the present invention is to provide a recreational device of the above mentioned nature, which will compensate for the differences in the impacts caused by differences in the height of fall and/or in the weight of the users falling on said nets of elastic bands, so as to avoid undue deflection of individual ones of said bands.

Still one other object of the present invention is to provide a recreational device of the aforementioned character, which will permit the simultaneous "jump" of several persons throughout the height thereof under optimal safety conditions.

The above described objects, as well as other objects and advantages ancillary thereto, are accomplished as follows:

In accordance with a preferred embodiment of the invention, a recreational device is provided for producing the thrill of a series of consecutive free falls on the users, which includes a housing, a shock absorbing cushion throughout the bottom of the housing, and an inwardly extending peripheral deck near the top of the housing. The deck has an area sufficient to accommodate a predetermined number of persons and arranged to provide a launching platform for allowing persons to jump into the housing. A plurality of horizontal planar non-woven nets of elastic bands are arranged at selected considerably spaced different levels within the housing with each net spanning the whole horizontal cross section of the housing. Each net is formed by a plurality of said elastic bands which have their two opposite ends fixedly attached to the interior surfaces of the side walls of the housing, each individual elastic band extending in a non-woven horizontal position throughout its length across the housing. The elastic bands are randomly arranged within each individual net to form elastic horizontal networks leaving spans between the bands which are sufficiently small to prevent a person jumping from the deck or from one of the nets onto the next lower net, from passing through the net all the way down the housing without bouncing on each consecutive net, but with the elastic bands having an elasticity sufficient to permit persons to manually space the bands to jump from a higher net of bands to a lower net of bands. Each horizontal planar non-woven net may be constituted by from 2 to 4 levels of elastic bands, said levels of bands being closely spaced from each other within an individual net to permit reinforced bounce of heavy persons whose weight or height of fall may deflect the upper ones of said band levels in an individual net beyond a permissible tolerance, the upper ones of said band levels being therefore assisted by the lower ones of said base levels in each net for increasing the flexural strength of the individual net as the height of fall and/or the weight of the person increases. The recreational device may be provided with vertically arranged nets, either elastic or non-elastic, in order to divide the cross section thereof into a plurality of sectors, so as to provide separate and isolated vertical paths to the users, thus enabling a plurality of persons to simultaneously jump throughout the height of the device.

BRIEF DESCRIPTION OF THE DRAWINGS

The features that are considered characteristic of the present invention will be set forth with particularity in the appended claims. The invention itself, however, both as to its organization and its method of operation, together with other objects and advantages thereof, will best be understood from the following description of specific embodiments, when read in connection with the accompanying drawings, in which:

DETAILED DESCRIPTION

Figure 1:
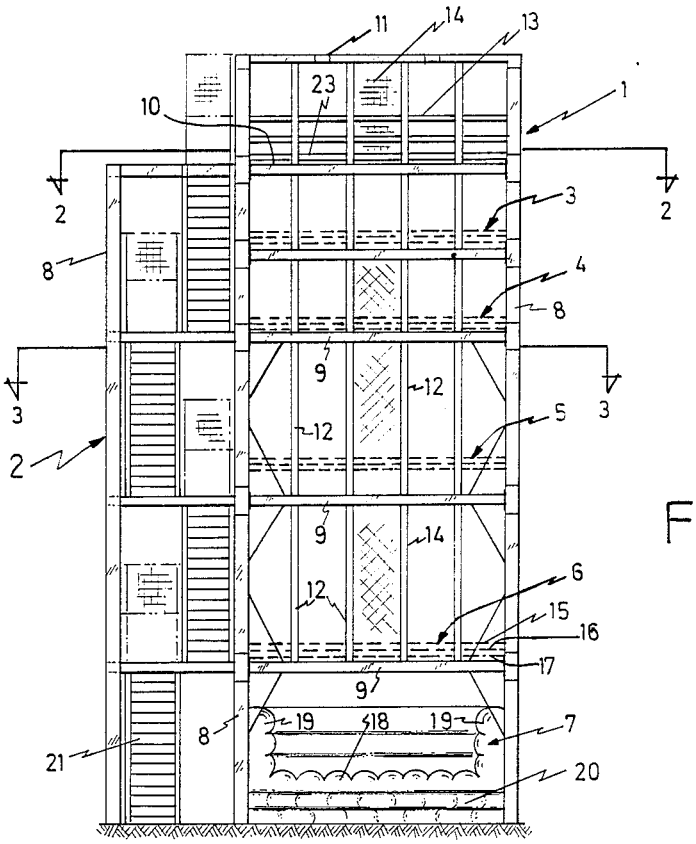
FIG. 1 is a diagrammatic elevational view of a recreational device for producing a series of entirely free falls, built in accordance with a preferred embodiment of the present invention.
Figure 2:
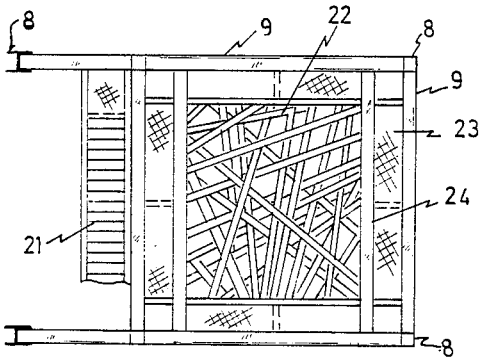
FIG. 2 is a cross-sectional plan view of the recreational device, taken along lines 2—2 of FIG. 1 and looking in the direction of the arrows.
Figure 3:
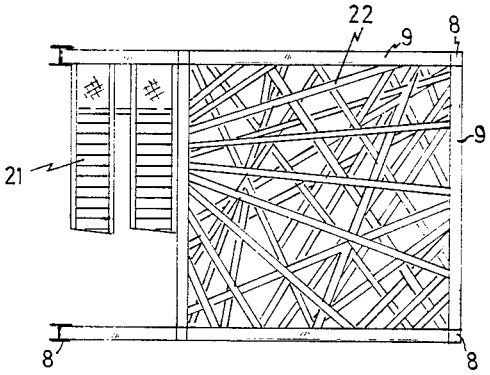
FIG. 3 is a cross-sectional plan view of the recreational device, taken along lines 3—3 of FIG. 1 and looking in the direction of the arrows.

Having now more particular reference to the drawings and more specifically to FIGS. 1 to 3 thereof, there is shown a recreational apparatus for producing a sequence of entirely non-arrested free falls from one level to the next through a plurality of said levels throughout the height of the device, which essentially comprises a housing 1, which may be of any suitable shape at the election of the designer, but which in the particular instance of the embodiment illustrated in FIGS. 1 to 3 comprises a rectangular structure which will be described in more detail hereinbelow, to which a staircase 2 is attached at one side thereof as will also be more clearly described hereinbelow. Within the rectangular structure or housing 1, a plurality of elastic nets 3, 4, 5 and 6 formed in turn by a plurality of individual layers of non-woven elastic bands attached to the structure or frame 1 are arranged, said nets 3, 4, 5 and 6 being arranged at different levels throughout the height of housing 1, and in the particular embodiment shown in FIG. 1, comprising three individual layers of elastic bands as shown, for a purpose which will appear more clearly explained in the description which follows. The recreational device is completed by a pneumatic cushion 7 arranged throughout the cross-section of the housing 1 and at the bottom thereof, as a safety device for preventing damage of the persons jumping through the device, that is, for preventing persons from hitting the floor.

The rectangular housing or frame 1 is generally formed by a plurality of columns 8 which are arranged at the corners of the housing as more clearly shown in FIGS. 2 and 3 of the drawings, as well as at the corners of the staircase 21 also as shown in said figures. Said columns 8 are connected by means of beams 9, arranged at different levels throughout the height of housing 1, and coinciding with the staircase stretches as shown. The upper beams 10 or struts serve to hold a platform 23 assisted by means 24 attached to beams 10 inwardly of the housing as shown in FIG. 2 of the drawings, and the top beam 11 arranged at the top of the columns 8, serves for supporting a roof or the like, when the latter is desired to cover the housing and protect the users against the rainfall or the like.

A plurality of vertically arranged reinforcing struts 12 are arranged throughout all the walls of the housing 1 as shown, at equidistant positions between each pair of columns 8, in order to arrange between said struts 12, the rigid supports for the elastic bands 22 which will be described in more detail in connection with FIGS. 4 and 5 of the drawings.

A safety net 14 of any suitable material such as cord or the like, particularly a non-elastic netting, indicated by means of the general character 14 and shown only partially in FIG. 1 of the drawings, is arranged around the perimeter of the housing 1, in order to form the walls thereof, and serving as a safety device to prevent persons jumping through the device from falling aside when rebounding on the nets 3, 4, 5 and 6 as will be described hereinbelow.

A protection railing 13 is arranged throughout the perimeter of the device at the level of beam 10 and platform 23, as an additional safety device for preventing people from falling towards the sides of the device when using the same. Also, the protective net provided in this section of the device is preferably a rigid net such as of steel and the like, although this is not a limiting feature of the invention, inasmuch as said net 14 may be of the same material as the net arranged on the remainder of the device.

Each one of the individual elastic nets 3, 1, 5 and 6 of the device is arranged at a different level at the selection of the designer, and each one of said nets is formed by at least three separate layers 15, 16 and 17 of non-woven elastic bands 22, each of said layers being arranged with the bands attached to a particularly designed attachment device which will be described in connection with FIGS. 4 and 5 of the drawings, and spans from one beam 9 to other of said beams 9 as shown in FIGS. 2 and 3 of the drawings, forming a non-woven layer in which the spacement of the bands 22 is insufficient to permit any person hitting thereon to pass directly through the said layer, and each of said individual layers 15, 16 and 17 forming each individual net 3, 4, 5 and 6, are arranged at a distance from the next upper layer, such that they will act as a contributing factor to the strength of the nets, when the height of fall and/or the weight of the person falling thereon increases. For example, if a child or some other light weight person falls on the net 4, jumping from platform 23 of the device, then the only layer which will net is layer 15 or upper layer of said net 3, because the weight of the person will not be sufficient to deflect the elastic bands 22 to a degree in which the layer 15 may hit the layer 16 of said bands. If a medium weight person jumps, then the weight of said person will be sufficient to deflect the bands 22 of layer 15 a sufficient amount, whereby the body of said person, together with the bands 22 of the first layer 15, will catch the second or intermediate layer 16, thus reinforcing the resistance of the net in order to avoid an undue deflection of the bands 22. Further, if a heavy weight person jumps, then the first layer 15 will catch the second layer 16 and both will hit on the third layer 17 or lower layer, whereby the three layers will resist the weight of the person, thus avoiding again an undue deflection of the individual bands 22 of each one of said layers and consequently an undue deflection of the individual nets 3, 4, 5 and 6.

The cooperation of each individual layer 15, 16 and 17 is optimal when the spacement of said layers 15 is of from about 5 to about 10 inches and will permit undue deflection of the individual bands 22 of each layer, both when the weight of the person increases and when the height of the fall increases, whereby as shown in FIG. 1 of the drawings, in net 6, it is most probable that all the individual layers 15, 16 and 17 will be always acting together, because the fall from net 5 to net 6 is of a considerable height as compared to the fall in the other stretches of the fall.

As mentioned above, the spacing of the randomly distributed non-woven elastic bands 22 of each layer 15, 16 and 17 of each one of said nets 3, 4, 5 and 6, will not be sufficient to permit persons from directly passing through said layers without bouncing thereon, but said bands are of an elasticity and flexibility sufficient to permit the persons to space the bands either with the body or with the arms or legs, in order to work their way through the whole net, so as to jump from one net to the next lower net. The jump from each net to the next lower one, in view of the above description, will be an entirely free fall which produces a thrill which is absolutely different to any thrill produced by any device of the prior art and the bouncing of the person falling on each one of said nets will be controlled by the expedient of providing the three different and separate layers of elastic bands, which assist each other in controlling the deflection of the bands.

As mentioned above, a cushion 7, which preferably is a pneumatic cushion inflated with air, is provided to offer absolute safety in the fall, both for finalizing the ride and for preventing any accident should a net break, and said cushion 7 comprises a bottom 18 and three side walls 19 which leave an exit at the front side of the device, wherein a ramp 20 is also formed as a separate or as an integral pneumatic cushion, is provided to permit the persons to exit the device.

Figure 4:
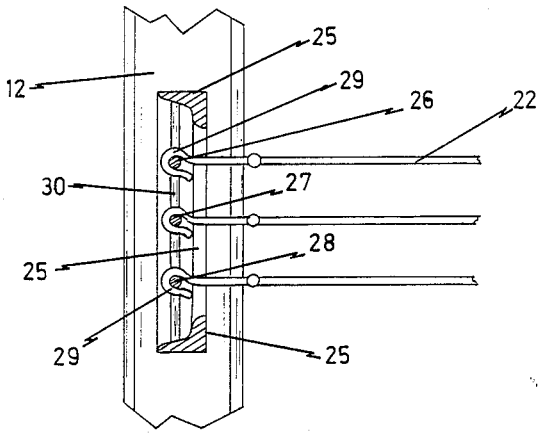
FIG. 4 is a cross-sectional fragmentary elevational view of a preferred embodiment of the support for the elastic bands forming the nets of the device of the present invention.

Although the elastic bands 22 may be arranged and attached in any suitable form, such as by merely tying the same to stretches of the protective net 14, or by hooking the same to suitable angular rigid members by means of holes provided at the horizontal flange of said members, in accordance with a preferred embodiment of the invention, a support 25 is provided between each pair of vertical struts 12, as more particularly shown in FIG. 4 of the drawings. Said support comprises a square frame of a suitable structural profile such as an angle 25, which comprises a vertical net of horizontal members 26, 27 and 28 located at the desired levels for each one of the layers 15, 16 and 17, respectively, and a plurality of vertical members 30 welded or integrally engaged to said horizontal members 26, 27 and 28 by any suitable means, in order to form a net such as shown in FIG. 5 of the drawings. Said support 25 is attached to each pair of struts 12 as shown in FIGS. 4 and 5 of the drawings or to one of the columns 8 and strut 12, at the corners of the device as may be easily visualized by any one having sufficient knowledge in the art.

Figure 5:
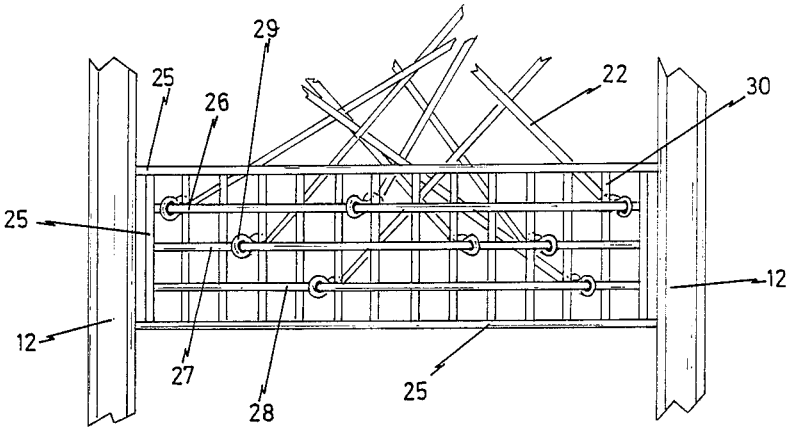
FIG. 5 is an elevational fragmentary view of the support shown in FIG. 4.

Each individual elastic band 22, as shown in figures 4 and 5 of the drawings, is attached to the horizontal members 26, 27 or 28, by means of suitable hooks 29, each hook being then supported within an individual square of the net formed by the horizontal members 16, 27 and 28 and the vertical members 30, in order to maintain a predetermined fixed position at each layer 15, 16 and 17 of the nets.

The individual bands 22 of each individual layer 15, 16 and 17, as attached by means of hooks 29 to the horizontal members 26, 27 and 28, respectively, of the support 25, are randomly distributed throughout the cross-sectional area of the housing 1, as mentioned above and as shown diagramatically in FIG. 5 of the drawings, in order to provide the coverage described above to prevent any person from passing through each individual layer without bouncing thereon.

The ride provided by the recreational device of the present invention is as follows. A person goes up the staircase 21 to reach the platform 23, from which he jumps on the net 3 located at a distance of about 5 feet below platform 23, rebouncing thereon as described above, inasmuch as the spacing of the elastic bands 22 will not permit him to pass through the net 3. After working his way by spacing the elastic bands 22 of the net 3, the user will launch himself towards the net 4, which is preferably located a short distance below the net 3, such as for instance, a distance of 8 feet or the like, in order to effect a short free fall which will prepare him for the next falls to come. The user repeats the operation of working his way through the elastic bands 22 of net 4, in order to lauch himself onto band 3 which is spaced at a distance larger than the spacing between nets 3 and 4, such as for instance a distance of 12 feet or the like, so as to provide a more thrilling sensation of a free fall. The free fall will be completely arrested by net 5, and the user, after bouncing against net 5, will work his way through the space below, in order to make the large jump of about 18 feet, from net 5 to net 6. After bouncing against net 6, the user again works his way through the net in order to bounce on the bottom 18 of the pneumatic cushion 7, wherefrom he will exit the device through ramp 20.

For safety considerations, the device of the present invention may be safely used only by one person at a time, namely, when a person has jumped from net 4 to net 5, one other person may start the ride, which is a limitation on the capacity of the device. In order to increase the capacity of the device without however affecting the safety considerations, one other embodiment of the present invention provides for a device which is of an entirely similar construction to the device shown in FIGS. 1 to 5, but with the addition of two vertical partition nets 31 and 32, which divide the cross-section of housing 1 into four sectors 33, 34, 35 and 36, absolutely separated from each other and forming isolated drafts for permitting the fall of one person, whereby the capacity of the device may be increased by four because the nets 31 and 32 will avoid one person from hitting the other when jumping simultaneously from the desk of the recreational device in accordance with the present invention.

The nets 31 and 32 may be flexible but non elastic nettings arranged throughout the height of the device or may be flexible and elastic nettings formed by woven-elastic bands such as bands 22 used for the nets 3, 4, 5 and 6, and said nets 31 and 32 may even be comprised by a pair of nets spaced from each other, in order to provide an intermediate empty space which will add to the safety factor of the device.

Figure 6:
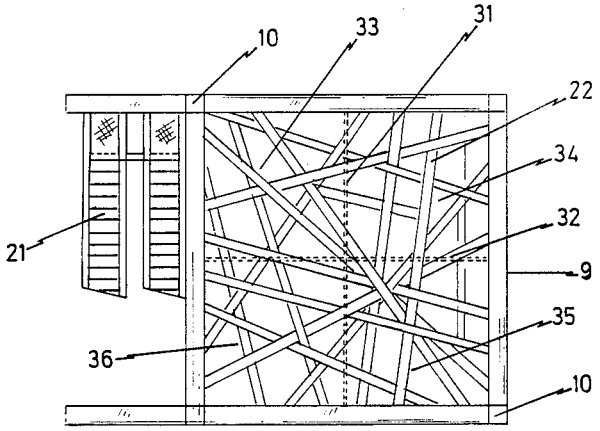
FIG. 6 is a cross-sectional plan view similar to that shown in FIG. 3, but showing a second embodiment of the invention wherein the cross section of the device is divided into individual sectors.

The jumping of several persons at the same time through a device built in accordance with the embodiment shown in FIG. 6, will provide an additional thrill of establishing a competition between the various users jumping simultaneously through the device, and will also provide the sensation of a waving motion each time a person falls on the nets, because of the dephasing of the instant of bouncing on the nets between the different four persons jumping practically simultaneously through the device. However, the thrill or sensation of an entirely free fall is also provided by the embodiment shown in FIGS. 1 to 5 of the drawings, which is the result sought by the device of the present invention and said entirely free falls will always be controlled and arrested by the special type of horizontal non-woven nets provided in the device, which compensate for the height of fall and for the difference in weight of the users to prevent undue deflection of the bands.

Although certain specific embodiments of the present invention have been shown and described, it must be pointed out that many modifications thereof are possible. Therefore, the present invention is not to be regarded as restricted except insofar as is required by the prior art and by the spirit of the appended claims.

What is claimed is:

1. A recreational device for producing the thrill of a series of consecutive free falls comprising an elongated vertical housing having a bottom, side walls and a top, a shock absorbing cushion throughout the bottom of the housing, an inwardly extending deck near the top of the housing, said deck having an area sufficient to accommodate a predetermined number of persons and arranged to provide a launching platform for allowing said persons to jump into the housing, a plurality of horizontal non-woven elastic net means arranged at different and considerably spaced levels within the side walls of the housing, with each of the net means spanning the whole horizontal cross section of the housing, each of the net means comprising from 2 to 4 parallel individual planar non-woven nets closely vertically spaced relative to each other, each individual one of the nets being formed by a plurality of horizontal elastic bands randomly distributed and attached to the interior surfaces of the side walls of the housing, the vertical distance between the uppermost one of the nets of each one of said plurality of net means and the lowermost one of the nets of said one of said plurality being smaller than the vertical distance between the spaced levels of said plurality of net means, whereby the spacing between the nets of each of the net means provides for compensation of the impact produced on each of the net means by a person regardless of the weight of that person and the height of free fall onto the net means by that person, the upper ones of the individual planar non-woven nets in said net means being sufficiently close to the lower ones thereof to effect said impact compensation by the lower ones catching said upper ones when a sufficiently heavy person landed on said upper ones, said elastic bands being randomly horizontally arranged in said individual nets with a density sufficient to provide spans between the bands of said net means which are sufficiently small to prevent a person jumping onto each said net means from passing through the net means without bouncing on said net means, said elastic bands having an elasticity sufficient to permit persons to manually space the same to work their way through said net means and jump to the next one of said net means located at a considerably lower level, the distance between the spaced levels of said net means selected to produce an entirely free fall between said net means.

2. A recreational device according to claim 1 wherein said housing is a rectangular structural frame and said side walls of said housing are formed by vertical woven flexible non-elastic protective nets attached to members of said rectangular frame throughout the height of said housing.

3. A recreational device according to claim 2 wherein the bands of the individual nets of said net means are attached to the vertical protective nets by means selected from hooks and knots.

4. A recreational device according to claim 2 and including rigid supports for the elastic bands of the individual nets of said net means, attached to vertical members of the frame and extending throughout the perimeter of said housing at said preselected different spaced levels to provide support for each of said net means.

5. A recreational device according to claim 4 wherein said supports for the elastic bands are nets of a rigid material attached to said vertical members of said frame, and comprising from 2 to 4 horizontal members arranged at said closely spaced levels to provide for hooking thereon the said elastic bands forming each of said individual planar non-woven nets of the net means.

6. A recreational device according to claim 4 wherein said supports for the elastic bands are constituted by from 2 to 4 angular rigid horizontal members attached to said vertical members of said frame, and extending throughout the perimeter of the housing, each of said angular rigid members being arranged at said closely spaced levels to provide for attachment of the bands of each of said individual nets of the net means, by means of hooks inserted into holes of a horizontally extending flange of said angular rigid members.

7. A recreational device according to claim 1, wherein the spacing of the individual nets within each of said net means is of from 5 to 10 inches.

8. A recreational device according to claim 7 wherein the spacing of the net means from each other and from said deck is of from 5 to 18 feet.

9. A recreational device according to claim 1 and including at least one vertical flexible partition net spanning the full height of the housing and attached to opposite ones of said side walls of housing, in order to consitute a partition to divide the housing into at least two separate sectors, each of said sectors forming a draft for permitting a person to jump simultaneously with and separated from another person jumping through another draft formed by another of said sectors.

* * * * *